US005762252A

United States Patent [19]

Reitano

[11] Patent Number: 5,762,252

[45] Date of Patent: Jun. 9, 1998

[54] DETECTOR FOR REGIONS OF EXCESS THICKNESS IN A MOVING WEB AND WEB TRANSPORT SYSTEM INCLUDING SUCH DETECTOR

[75] Inventor: Frank J. Reitano, Rochester, N.Y.

[73] Assignee: Eastman Kodak Company, Rochester, N.Y.

[21] Appl. No.: 846,945

[22] Filed: Apr. 30, 1997

[51] Int. Cl.[6] ..... B65H 26/00; H01H 9/00

[52] U.S. Cl. ..... 226/45; 200/61.13; 200/61.15; 226/100

[58] Field of Search ..... 226/24, 45, 48, 226/100; 200/61.13, 61.15, 61.41, 61.42

[56] References Cited

U.S. PATENT DOCUMENTS

| | | | |
|---|---|---|---|
| 2,237,341 | 4/1941 | Dungler | 200/61.13 |
| 3,044,675 | 7/1962 | Turner et al. | 226/100 X |
| 3,301,974 | 1/1967 | Hancock | 200/61.13 |
| 3,502,827 | 3/1970 | Beebe | 200/61.13 |
| 3,591,170 | 7/1971 | Doughty et al. . | |
| 3,842,668 | 10/1974 | Lippke | 200/61.13 X |
| 3,854,643 | 12/1974 | Weaver | 226/45 X |
| 3,886,338 | 5/1975 | Lokun et al. | 200/61.13 |
| 4,017,014 | 4/1977 | Luscher . | |
| 4,314,757 | 2/1982 | Anderson et al. . | |
| 4,583,669 | 4/1986 | Sirkis . | |
| 5,153,715 | 10/1992 | Bender et al. | 348/223 |
| 5,215,008 | 6/1993 | Kartovaara et al. | 200/61.14 X |
| 5,248,073 | 9/1993 | Tschiderer . | |

*Primary Examiner*—Michael Mansen

*Attorney, Agent, or Firm*—Charles E. Snee, III; Gordon M. Stewart

[57] ABSTRACT

A detector (14) for regions of excess thickness in a moving web (12*a*) includes a first jaw member (120; 72, 82); a second jaw member (122; 68, 70); a frame (56; 120*a*, 122*a*) supporting the first and second jaw members with a gap (88; 138) there between through which a web can be transported, the gap having a width more narrow than a maximum desired thickness of a transported web; a support (52, 54; 116, 118; 160, 162; 164, 166) for the frame to allow the frame and the first and second jaw members to move when a web having a region of thickness in excess of the width of the gap engages the jaw members at the gap; and a sensor (96–100; 148–152) for detecting movement of the frame to indicate presence of a region of excess thickness at the gap. A web transport system embodying such a detector also is disclosed.

14 Claims, 4 Drawing Sheets

DETECTOR FOR REGIONS OF EXCESS THICKNESS IN A MOVING WEB AND WEB TRANSPORT SYSTEM INCLUDING SUCH DETECTOR

FIELD OF THE INVENTION

The invention concerns apparatus for transporting webs which may include regions of excess thickness. More particularly, the invention concerns a system or transporting webs made from tape-spliced or stapled photographic filmstrips. The system may include a detector for regions of the web having excess thickness which could jam or damage downstream portions of the system.

BACKGROUND OF THE INVENTION

Apparatus is known for scanning photographic color film negatives or transparencies in a plurality of individual component colors. Commonly assigned U.S. Pat. No. 5,153,715, which is hereby incorporated by reference into this description, discloses such an apparatus in which a solid state image scanning array comprises a plurality of parallel linear array sensors which are aligned with a scan aperture. The sensors are exposed directly to an image projected from a film negative or transparency positioned at a film plane at the scan aperture. There is no need for any optical features such as lenses or beam splitters between the film and the sensors. The sensors are in near or virtual contact with the film, there being typically only about 2.5 mm spacing between the two. With a typical cover glass for such array sensors being about 0.65 mm thick, a very narrow passage about 1.0 mm wide remains between the cover glass and the film. The output from the sensor array can be used in a digital printer to produce so-called index prints including small imagettes of the images on a filmstrip, to produce larger prints digitally, or to adjust the color balance of a conventional optical photographic printer to produce conventional photographic prints.

Although the apparatus disclosed in the commonly assigned patent functions admirably for the purposes just mentioned, problems can arise due to the nature of a typical web of film negatives or transparencies to be scanned. Conventionally in a wholesale photofinishing laboratory, undeveloped filmstrips from many customers ' orders are spliced together to form a web which is then transported through a processor to develop the film. Then, the web of developed negatives or transparencies is electronically scanned. The splicing may be done by splice tapes or staples between individual orders. The splices, particularly those made with staples, may be of a thickness in excess of what can be tolerated by the narrow passage of a scanning apparatus of the type described in the preceding paragraph. Staples may scratch the cover glass of the scanning array. Staples or unusually thick splices may jam in the narrow passage. Though staples are supposed to be removed prior to scanning, often some will remain in the web to cause problems downstream. Thus, a need has arisen for a technique to detect regions of excess thickness of a web of spliced filmstrips, such as would be caused by staples or abnormal splices.

Proximity sensors have been used to detect the influence of metal staples on a magnetic field as a web is transported past the sensor; however, the field fluctuations are very small and difficult to detect. When the sensitivity of proximity sensors is set at a level high enough to detect staples, false signals become common. And, proximity sensors are not able to detect regions of excess thickness, such as abnormal taped splices, which do not include staples.

Other types of sensors, such as those shown in U.S. Pat. Nos. 3,591,170 and 4,583,669 are known for detecting splices in webs. These sensors include spring-biased pinch rollers or pivotable contact elements which establish a variable gap between the roller or contact element and an opposing, fixed roller or web guide. A thickened portion of a passing web will cause the roller or contact element to move and actuate a sensor. In these sensors, however, rather small movements of the rollers or contact elements must be detected, which can be difficult to do reliably. A need has existed for a sensor which can reliably detect small changes in thickness of web.

SUMMARY OF THE INVENTION

A detector in accordance with the invention is useful for sensing regions of excess thickness in a moving web. As such the detector may include a first jaw member; a second jaw member; and a frame supporting the first and second jaw members with a gap there between through which a web can be transported. The gap has a width more narrow than a maximum desired thickness of a transported web. A support for the frame allows the frame and the first and second jaw members to move, such as by pivoting or translating, when a web having a region of thickness in excess of the width of the gap engages the jaw members at the gap. A sensor detects movement of the frame to indicate presence of a region of excess thickness at the gap.

A resilient member may be included for allowing the jaws to move apart to allow a region of excess thickness to pass through the gap, thereby reducing chances of jamming. The jaws may be defined by first and second rollers supported for rotation on the frame, the gap being between the rollers. The support may include a pivot about which the frame can rotate when a region of excess thickness engages the jaw members at the gap. Alternatively, the support may include a track along which the frame can translate when a region of excess thickness engages the jaw members at the gap. A resilient member may be provided for biasing the frame to a home position.

A web transport system including the detector of the invention also may include a source of web which may include regions of excess thickness and a source of power to transport the web along a path through the gap between the jaw members. The sensor may produce a signal upon detecting movement of the frame and a control responsive to the signal may be included for stopping transport of the web along the path. The web may be formed from a plurality of photographic filmstrips joined by staples or splices. In the latter case, the transport system may include, downstream of the sensor, means for electronically scanning the filmstrips, the means for electronically scanning comprising a further gap through which the web passes, the further gap being greater than the maximum desired thickness.

The detector and web transport system according to the invention provide various advantages. Both staples and other potentially troublesome regions of excess thickness, such as abnormal taped splices, are detected. Incidence of false signals essentially is eliminated. Popular metallic splice tapes may be used with the invention, since the metal properties of the splice tape will not interfere with operation of the invention, as they might with a proximity detector. The detector is inexpensive and simple to install in a web transport system. The detector is insensitive to velocity of the web, environmental conditions or changes in composition of the web. A variety of sensor types can be used, to permit interface with different types of controllers.

DETAILED DESCRIPTION OF THE INVENTION

Figure 1:
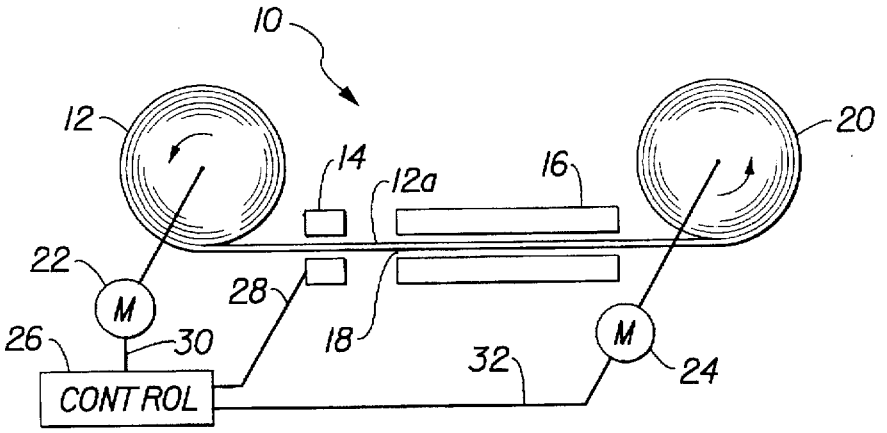
FIG. 1 shows a schematic view of a web transport system embodying the invention.

The invention will be described with reference to the drawings, in which like reference numerals identify like elements of structure in each of the several Figures.

FIG. 1 shows a web transport system 10, such as might be included in a scanner for webs of spliced photographic filmstrips. A source 12 of web material, such as a spool of spliced filmstrips, delivers a web 12*a* which is transported through a detector 14 for regions of excess thickness in the web, such as staples or abnormal splices. A film scanning apparatus 16 of the type previously mentioned receives the web, which passes through a gap or narrow passage 18 within scanning apparatus 16. A take-up spool 20 receives the web after scanning. A pair of motors 22, 24 may be provided for driving source 12 and spool 20 under the control of a conventional programmable controller 26 which is connected by electrical control cables 28, 30, 32 to detector 14, motor 22 and motor 24, respectively. During transport of web 12*a*, a region of excess thickness of the web could cause damage to or jam within scanning apparatus 16.

Figure 2:
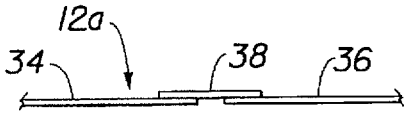
FIG. 2 shows a schematic view of a taped splice between sections of a web.
Figure 3:
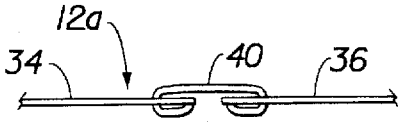
FIG. 3 shows a schematic view of a stapled splice between sections of a web.

As shown in FIG. 2, web 12*a* may include a plurality of filmstrips or sections 34, 36, only two of which are shown. The filmstrips may be joined by a piece of splice tape 38 or, as shown in FIG. 3, one or more splice staples 40, or some combination of the two. Thus, abnormally thick splices or staples may produce in web 12*a* regions of excess thickness with thicknesses greater than the maximum thickness which can be tolerated by scanning apparatus 16. The detector and web transport systems of the invention can sense such regions of excess thickness and stop transport of the web before the scanning apparatus is damaged.

Figure 4:
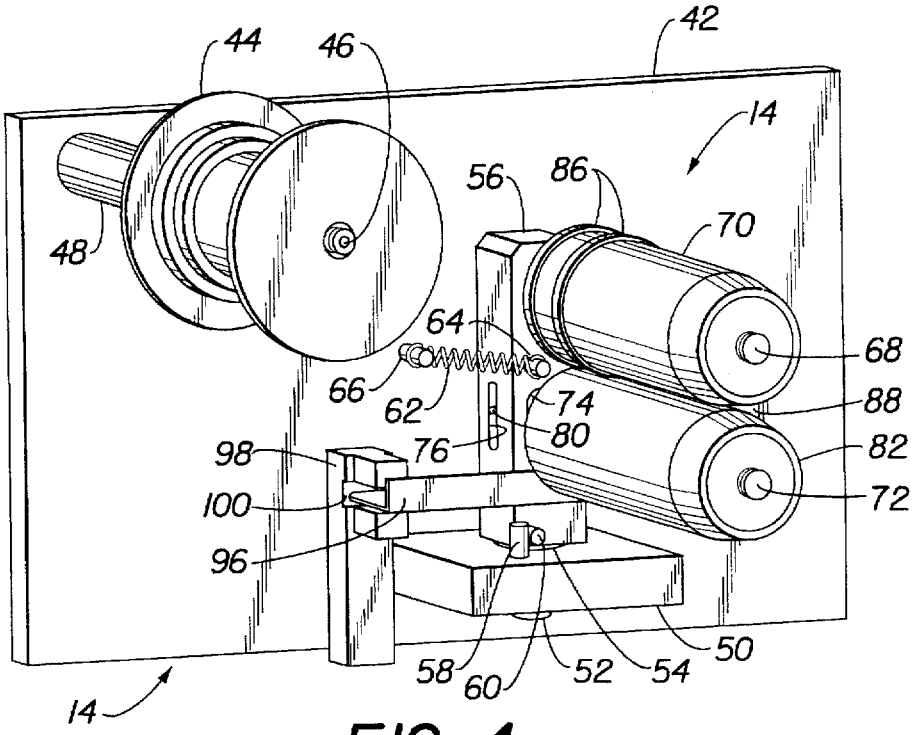
FIG. 4 shows an elevation perspective view from the left of a detector in accordance with a first embodiment of the invention.
Figure 5:
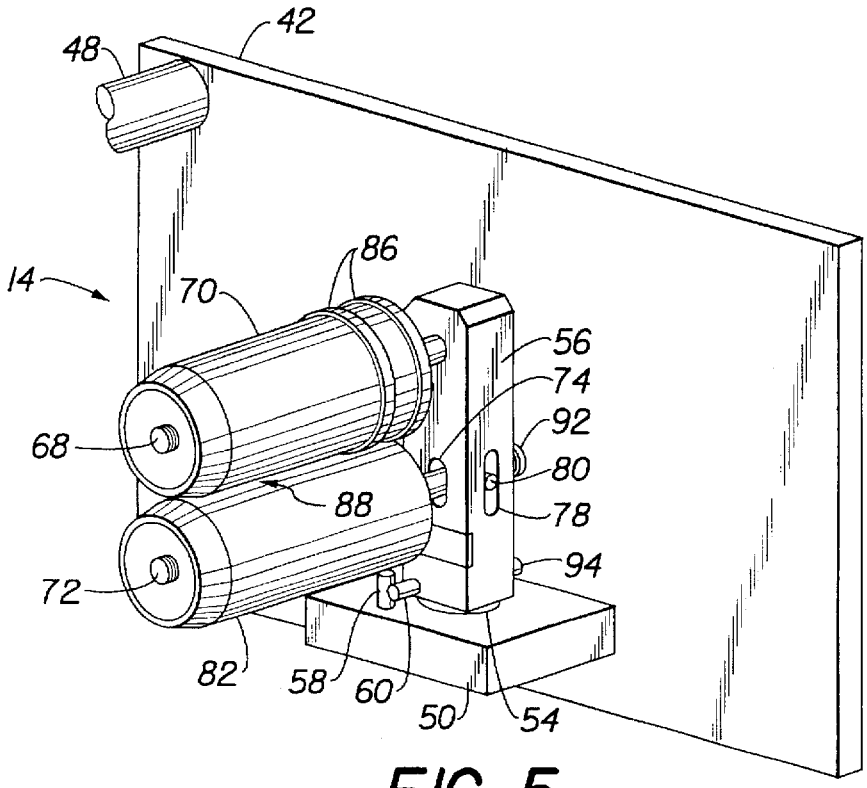
FIG. 5 shows an elevation perspective view from the right of the detector of FIG. 4.
Figure 6:
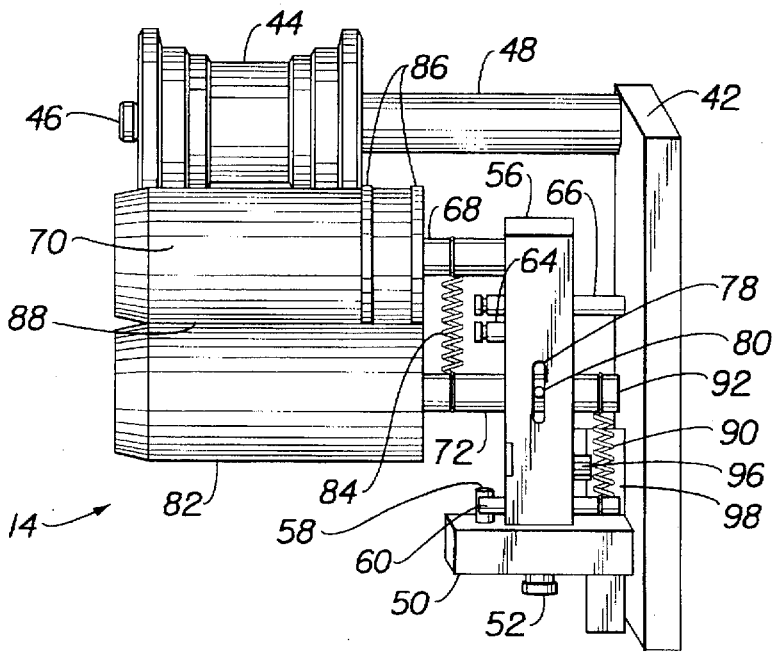
FIG. 6 shows a side elevation view from the right of the detector of FIGS. 4 and 5.

FIGS. 4 to 6 show a first embodiment of a detector 14 according to the invention. A rigid face plate 42 supports a guide roller 44 for web material entering the detector. For ease of illustration, the web material is not shown in the figure; however, those skilled in the art will appreciate that the web is threaded over roller 44 and on to the remainder of the detector now to be described. Roller 44 is mounted for rotation on a shaft 46 which extends from a stand-off member 48. Below and to one side of roller 44, a frame base or support plate 50 extends essentially horizontally from face plate 42. A pivot shaft 52 is supported essentially vertically by a bearing 54 mounted in a suitable bore in plate 50. An elongated roller support frame 56 is mounted coaxially for rotation with shaft 52. A vertical stop pin 58 is extended upward from plate 50 to engage a horizontal stop pin 60 extended from frame 56, when the detector is in its illustrated "home" position. A resilient return spring 62 extends between an anchor post 64 extended from frame 56 and an anchor post 66 extended from face plate 42. The tension applied by spring 62 thus holds the detector in the home position with stop pins 58, 60 engaged.

Near an upper end of frame 56, a fixed shaft 68 extends essentially horizontally to rotatably support a first jaw member, such as a roller 70. Below fixed shaft 68 extends a parallel, movable shaft 72 which passes through a vertically elongated through slot 74 in frame 56. Orthogonal to slot 74, frame 56 includes a pair of vertically elongated guide slots 76, 78 which receive opposite ends of a guide pin 80 carried by movable shaft 72. A second, movable jaw member, such as a roller 82, is supported on shaft 72. Thus, roller 82 and shaft 72 can be moved toward and away from roller 70 and shaft 68, while guide pin 80 and slots 74, 76, 78 hold the shafts essentially parallel. A spring 84 is mounted between shafts 68, 72 to bias the rollers into contact. Each of the rollers preferably is covered with a sleeve of non-abrasive material, such as polytetrafluoroethylene plastic, to minimize chances of damaging web 12*a*. A pair of circumferentially extended rims or lands 86 are provided on roller 70 at its inboard end nearer frame 56. The presence of the rims or lands causes a gap 88 to be defined between the rollers. Gap 88 has a radial width more narrow than a maximum desired thickness which can be accommodated by scanner 16. For example, gap 88 may be about 0.003 inch (0.076 mm) narrower than the maximum desired thickness. Thus, if a web passing through gap 88 has regions of excess thickness greater than the width of the gap, the regions of excess thickness will become caught in gap 88, as will be explained more fully later in this description. Because the rims or lands are located at the inboard end of roller 70, gap 88 has an open outboard end through which web 12*a* can be easily inserted between rollers 70, 82.

As shown in FIG. 6, a spring 90 is mounted between a free end 92 of shaft 72 and a horizontal anchor post 94 extended from frame 56. Springs 84 and 90 help to hold shaft 72 parallel to shaft 68 and to maintain engagement of rims or lands 86 with roller 82. A sensor flag 96 extends horizontally from frame 56 to cooperate with a sensor 98 supported on face plate 42. Sensor 98 may be a conventional type including a light source which emits a beam to a detector. In the illustrated home position, sensor flag 96 extends into a gap 100 in sensor 98 to interrupt the light beam. The skilled person will appreciate that the invention is not limited to the use of such a sensor type and that limit switches, proximity switches and other sensing devices known in the art may be used to monitor movement of sensor flag 96.

In operation of the embodiment of FIGS. 4 to 6, web 12*a* is threaded over guide roller 44 and between rollers 70, 82.

Motors 22, 24 and scanning apparatus 16 are operated as required for proper scanning of the web. If web 12*a* includes a region of excess thickness, the region will become caught in gap 88, thus causing frame 56 to rotate in the direction of movement of the web. This movement causes sensor flag 96 to move away from sensor 98, which then sends a signal to controller 26 to indicate the presence of a region of excess thickness. Controller 26 then stops motors 22, 24 before the region of excess thickness reaches scanning apparatus 16. To prevent the web from tearing upon catching in gap 88, springs 84, 90 stretch to allow shaft 72 to move in slot 74. Roller 82 then can pivot about the rim or land 86 closest to frame 56, as that rim or land remains in contact with roller 70. Spring 84 contracts as spring 90 stretches, to allow this pivoting about rim or land 86. As a result, gap 88 opens sufficiently to allow the region of excess thickness to pass. Springs 90 then returns roller 82 to engagement with both rims or lands 86; and at the same time, spring 62 returns frame 56 to its home position.

Figure 7:
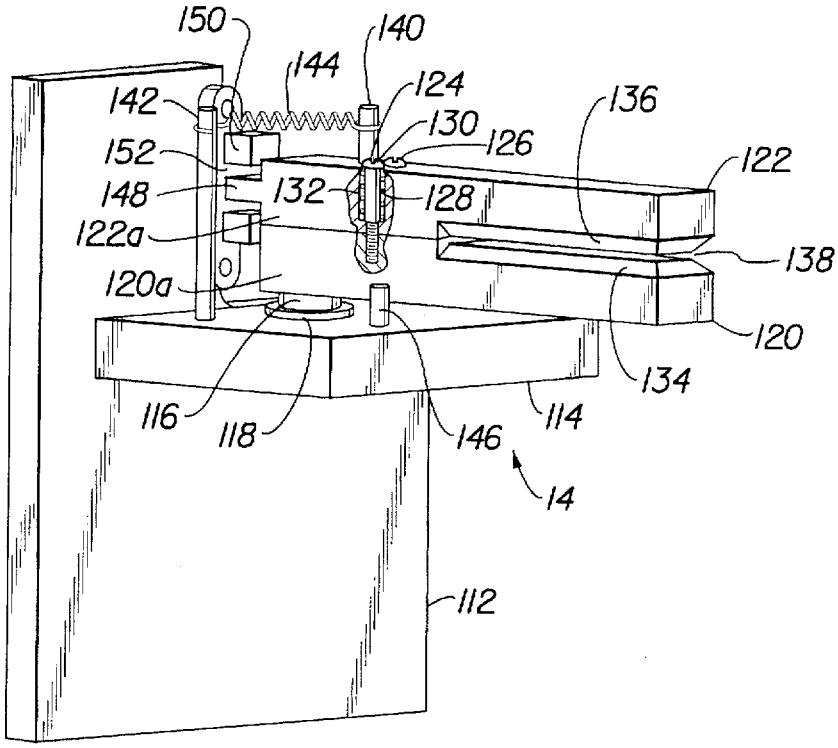
FIG. 7 shows an elevation perspective view from the left of a detector in accordance with a second embodiment of the invention.
Figure 8:
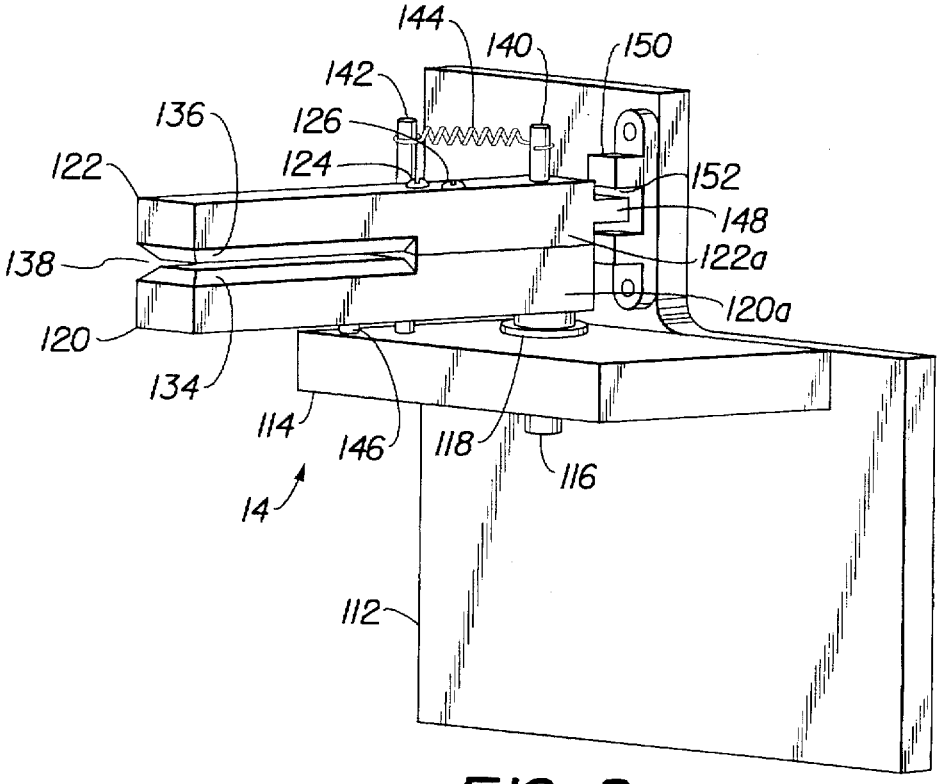
FIG. 8 shows an elevation perspective view from the right of the detector of FIG. 7.

FIGS. 7 and 8 show a second embodiment of a detector 14 according to the invention. A rigid face plate 112 may support a guide roller similar to roller 44, not illustrated. A frame base or support plate 114 extends essentially horizontally from face plate 112. A pivot shaft 116 is rotatably supported essentially vertically by a bearing 118 mounted in a suitable bore in plate 114. An elongated lower jaw member 120 has a base frame portion 120*a* which is fixed for rotation with shaft 116. An elongated upper jaw member 122 has a base frame portion 122*a* which contacts base frame portion 120*a*. A pair of shoulder screws 124, 126 position base frame 122*a* relative to base frame 120*a*. As shown in a fragmentary sectional view in FIG. 7, a resilient coil spring 128 is captured between a head 130 of screw 124 and a bottom surface of a counter bore 132 in base frame 122*a*. A lower end of screw 124 is threaded into base frame 120*a*. An identical arrangement, not shown, is provided for screw 126. Thus, the compression of spring 128 sets a force of engagement between base frames 120*a*, 122*a*. Around their ends spaced from shaft 116, jaw members 120, 122 are provided with chamfered or flared inlet and outlet surfaces 134, 136 which serve as guides for web 12*a* into a gap 138 between the jaw members. As in the case of gap 88, gap 138 has a width more narrow than a maximum desired thickness which can be accommodated by scanning apparatus 16. An anchor post 140 is extended upward from jaw member 122 and an anchor post 142 is extended upward from plate 114. A resilient sprint 144 extends between anchor posts 140, 142 to hold the jaw members in the illustrated "home" position against a rotational stop pin 146 extended upwardly from plate 114. A sensor flag 148 extends from an inboard end of base frame 122*a* to cooperate with a sensor 150 supported by face plate 112. Sensor 150 may be the same type as sensor 98. In the illustrated home position, sensor flag 148 extends into a gap 152 in sensor 150 to interrupt its light beam.

Figure 11:
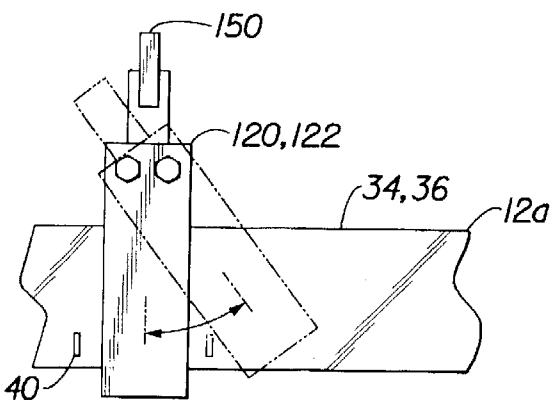
FIG. 11 shows a schematic plan view of the embodiment of FIGS. 7 and 8 in its home and pivoted positions.

In operation of the embodiment of FIGS. 7 and 8, web 12*a* is threaded over a guide roller, not illustrated, and between jaw members 120, 122. Motors 22, 24 and scanning apparatus 16 are operated as required for proper scanning of the web. If web 12*a* includes a region of excess thickness, the region will become caught in gap 138, thus causing the jaw members to rotate with shaft 116 in the direction of movement of the web. See FIG. 11. This movement causes sensor flag 148 to move away from sensor 150, which then sends a signal to controller 26 to indicate the presence of a region of excess thickness. Controller 26 then stops motors 22, 24 before the region of excess thickness reaches scanning apparatus 16. To prevent the web from tearing upon catching in gap 138, springs 128 compress further to allow jaw member 122 to move slightly upward. As a result, gap 138 opens sufficiently to allow the region of excess thickness to pass. Spring 144 then returns the jaw members to their illustrated home position against stop pin 146.

Figure 10:
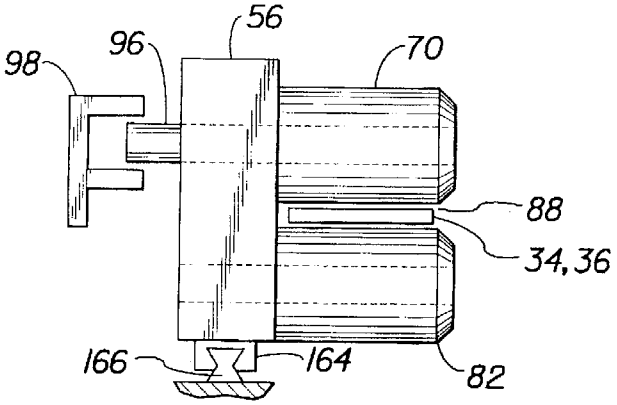
FIG. 10 shows a schematic right side elevation view of the embodiment of FIGS. 4 to 6, as mounted for translating rather than pivoting.
Figure 12:
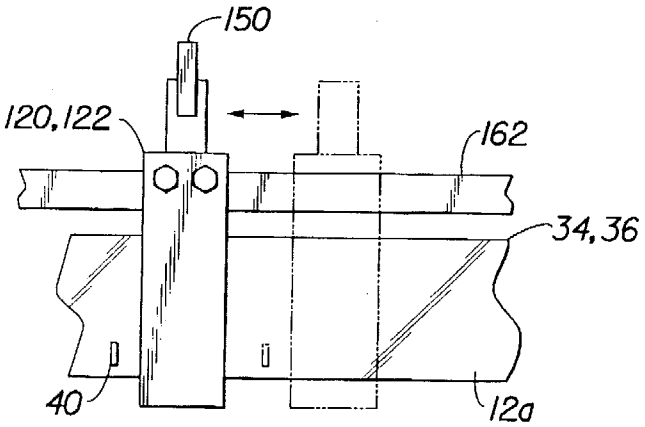
FIG. 12 shows a schematic plan view of the embodiment of FIGS. 7 to 9 in its home and translated positions.
Figure 9:
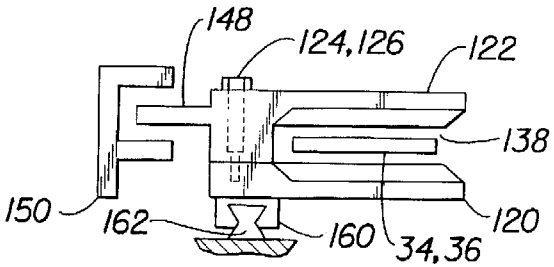
FIG. 9 shows a schematic left side elevation view of the embodiment of FIGS. 7 and 8, as mounted for translating rather than pivoting.

FIGS. 9 and 10 respectively show alternative arrangements of the embodiments of FIGS. 7 and 8; and 4 to 6. As shown in FIG. 9, rather than being mounted for pivoting on a shaft, base frame portions 120*a*, 122*a* may be mounted on a slide 160 which can translate along a track 162 positioned essentially parallel to the direction of travel of the web. Similarly, as shown in FIG. 10, frame 56 can be mounted on a slide 164 which can translate along a track 166. Thus, when a region of excess thickness engages gap 88 or gap 138, the jaws or rollers will translate along their associated track, thereby moving their associated sensor arm 96, 148 away from their associated sensor 98, 150. See FIG. 12, which shows how jaw members 120, 122 move along track 166.

The invention has been described in detail with particular reference to certain preferred embodiments thereof, but it will be understood that variations and modifications can be effected within the spirit and scope of the invention.

Parts List

10 . . . Web transport system
12 . . . source of web material
12*a* . . . source of web material
14 . . . detector for staples or splices
16 . . . film scanner
18 . . . gap
20 . . . take-up spool for web material
22, 24 . . . motors for 12, 20
26 . . . controller
28, 30, 32 . . . electrical cables
34, 36 . . . filmstrips/web sections
38 . . . splice tape
40 . . . splice staple
42 . . . face plate
44 . . . guide roller
46 . . . shaft of 44
48 . . . stand-off
50 . . . frame base/support
52 . . . pivot shaft
54 . . . bearing for 52
56 . . . roller support frame
58 . . . stop pin
60 . . . stop pin
62 . . . resilient return spring
64 . . . anchor post on 56
66 . . . anchor post on 42
68 . . . fixed shaft
70 . . . fixed roller/jaw member
72 . . . movable shaft
74 . . . elongated slot through 56
76, 78 . . . guide slots into 72
80 . . . guide pin on 72
82 . . . movable roller/jaw member
84 . . . spring between 68, 72
86 . . . circumferential rims on 70
88 . . . gap between 70, 82
90 . . . spring
92 . . . free end of 72
94 . . . anchor post on 56
96 . . . sensor flag
98 . . . sensor
100 . . . gap for 94

112 . . . face plate
114 . . . frame bese/support
116 . . . pivot shaft
118 . . . bearing
120 . . . jaw member fixed to 116
120*a* . . . base frame portion of 120
122 . . . jaw member
122*a* . . . base frame portion of 122
124, 126 . . . shoulder screws
128 . . . resilient spring
130 . . . head
132 . . . countr bore in 122
134, 136 . . . flared inlet surfaces on 120, 122
138 . . . gap between 120, 122
140 . . . anchor post on 122
142 . . . anchor post on 144
144 . . . resilient spring between 140, 142
146 . . . rotational stop
148 . . . sensor flag on 122
150 . . . sensor
152 . . . gap for 148
160 . . . slide
162 . . . track
164 . . . slide
166 . . . track

What is claimed is:

1. A detector for regions of excess thickness in a moving web, said detector comprising:

a first jaw member;

a second jaw member;

a frame supporting said first and second jaw members with a gap there between through which a web can be transported, said gap having a width more narrow than a maximum desired thickness of a transported web;

a support for said frame to allow said frame and said first and second jaw members to move when a web having a region of thickness in excess of said width of said gap engages said jaw members at said gap; and a sensor for detecting movement of said frame to indicate presence of a region of excess thickness at said gap.

2. A detector according to claim 1, further comprising a resilient member for allowing said jaws to move apart to allow a region of excess thickness to pass through said gap.

3. A detector according to claim 1, wherein said jaws are defined by first and second rollers supported for rotation on said frame, said gap being between said rollers.

4. A detector according to claim 1, wherein said support comprises a pivot about which said frame can rotate when a region of excess thickness engages said jaw members at said gap.

5. A detector according to claim 1, wherein said support comprises a track along which said frame can translate when a region of excess thickness engages said jaw members at said gap.

6. A detector according to claim 1, further comprising a resilient member for biasing said frame to a home position.

7. A web transport system, comprising:

a source of web which may include regions of excess thickness;

a source of power to transport said web along a path;

a first jaw member;

a second jaw member;

a frame supporting said first and second jaw members with a gap there between and said jaw members extended on either side of said path, said web passing through said gap and said gap having a width more narrow than a maximum desired thickness of said web;

a support for said frame to allow said frame and said first and second jaw members to move when a region of said web with a thickness in excess of said width of said gap engages said jaw members at said gap; and a sensor for detecting movement of said frame to indicate presence of a region of excess thickness at said gap.

8. A web transport system according to claim 7, further comprising a resilient member for allowing said jaws to move apart to allow region of excess thickness to pass through said gap.

9. A web transport system according to claim 7, wherein said jaws are defined by first and second rollers supported for rotation on said frame, said gap being between said rollers.

10. A web transport system according to claim 7, wherein said support comprises a pivot about which said frame can rotate when a region of excess thickness engages said jaw members at said gap.

11. A web transport system according to claim 7, wherein said support comprises a track along which said frame can translate when a region of excess thickness engages said jaw members at said gap.

12. A web transport system according to claim 7, further comprising a resilient member for biasing said frame to a home position.

13. A web transport system according to claim 7, wherein said sensor produces a signal upon detecting movement of said frame, further comprising a control responsive to said signal for stopping transport of said web along said path.

14. A web transport system according to claim 7, wherein said web comprises a plurality of photographic filmstrips joined by staples or splices, further comprising, downstream of said sensor, means for electronically scanning said filmstrips, said means for electronically scanning comprising a further gap through which said web passes, said further gap being greater than said maximum desired thickness.

* * * * *